US011534647B2

(12) United States Patent
Davis et al.

(10) Patent No.: US 11,534,647 B2
(45) Date of Patent: Dec. 27, 2022

(54) HIP ENGAGEMENT DEVICE AND METHOD OF USE THEREOF

(71) Applicant: Kinetics Activation LLC, Southfield, MI (US)

(72) Inventors: MacArthur Davis, Southfield, MI (US); Alaa Zara, Southfield, MI (US)

(73) Assignee: KINETICS ACTIVATION LLC, Southfield, MI (US)

( * ) Notice: Subject to any disclaimer, the term of this patent is extended or adjusted under 35 U.S.C. 154(b) by 295 days.

(21) Appl. No.: 16/825,232

(22) Filed: Mar. 20, 2020

(65) Prior Publication Data

US 2020/0298046 A1 Sep. 24, 2020

Related U.S. Application Data

(60) Provisional application No. 62/822,213, filed on Mar. 22, 2019.

(51) Int. Cl.

| | |
|---|---|
| ***A63B 21/055*** | (2006.01) |
| ***A63B 21/00*** | (2006.01) |
| ***A63B 21/04*** | (2006.01) |
| ***A63B 69/36*** | (2006.01) |
| ***A63B 69/38*** | (2006.01) |
| ***A63B 69/20*** | (2006.01) |
| ***A63B 69/00*** | (2006.01) |
| *A63B 102/32* | (2015.01) |

(52) U.S. Cl.

CPC .... *A63B 21/0552* (2013.01); *A63B 21/00069* (2013.01); *A63B 21/0442* (2013.01); *A63B 69/0002* (2013.01); *A63B 69/002* (2013.01); *A63B 69/0024* (2013.01); *A63B 69/20* (2013.01); *A63B 69/36* (2013.01); *A63B 69/38* (2013.01); *A63B 2069/0008* (2013.01); *A63B 2102/32* (2015.10); *A63B 2225/093* (2013.01)

(58) Field of Classification Search

CPC ..... A63B 21/0442; A63B 21/0552; A63B 21/0024; A63B 21/20; A63B 69/002; A63B 69/0024; A63B 69/20; A63B 69/36; A63B 69/38; A63B 2069/0008; A63B 2102/32; A63B 2225/093

See application file for complete search history.

(56) References Cited

U.S. PATENT DOCUMENTS

| | | | | |
|---|---|---|---|---|
| 5,277,170 A * | 1/1994 | Carella | ..... | F41B 5/1476 124/80 |
| 6,949,035 B1 * | 9/2005 | Halsworth | ..... | A63B 69/0026 482/121 |
| 7,048,638 B2 * | 5/2006 | Novotny | ..... | A63B 21/1663 473/219 |

(Continued)

*Primary Examiner* — Megan Anderson

(74) *Attorney, Agent, or Firm* — Blue Filament Law PLLC

(57) ABSTRACT

A method is provided for preventing back injuries related to sport motions or swings that includes setting an attachment height of a distal end of an elastic of a warmup and training device, the attachment height set to define an angle α backwards from vertical above center of a practice motion specific to a sport to be practiced, attaching a handle to a proximal end of the elastic where a type of the handle corresponds to the sporting activity to be performed, performing the practice motion while holding the handle and stretching the elastic, and returning to the beginning of the practice motion to repeat the activity.

10 Claims, 4 Drawing Sheets

(56) References Cited

U.S. PATENT DOCUMENTS

| | | | | |
|---|---|---|---|---|
| 8,251,877 | B2 * | 8/2012 | Rasmussen | A63B 21/0628 482/93 |
| 8,282,500 | B1 * | 10/2012 | Masching | A63B 15/00 473/226 |
| 9,370,702 | B1 * | 6/2016 | O'Reilly | A63B 69/00 |
| 2007/0010344 | A1 * | 1/2007 | Mackay | A63B 21/055 473/257 |
| 2008/0051263 | A1 * | 2/2008 | Rasmussen | A63B 23/03508 482/94 |
| 2011/0212797 | A1 * | 9/2011 | Adkins | A63B 69/0002 473/422 |
| 2012/0202611 | A1 * | 8/2012 | Warren | A63B 21/0552 473/422 |
| 2014/0031182 | A1 * | 1/2014 | Donofrio | A63B 21/0552 482/129 |
| 2018/0169494 | A1 * | 6/2018 | Williams | A63B 69/0057 |

* cited by examiner

HIP ENGAGEMENT DEVICE AND METHOD OF USE THEREOF

RELATED APPLICATIONS

This application claims priority benefit of U.S. Provisional Application Ser. No. 62/822,213 filed 22 Mar. 2019; the contents of which are hereby incorporated by reference.

FIELD OF THE INVENTION

The present invention generally relates to the field of sports and physical therapy, and in particular to warm-up and sports motion device for preventing injuries and improving sports performance.

BACKGROUND OF THE INVENTION

Currently the population of the United States and many other nations continues to age. Even though the population continues to age, sports participation continues to rise, as well as exercising to stay fit and active.

However, the increase in fitness and sporting based activities has also been accompanied with increased rates of participant injury. Back related injuries are quite common, as people strain their spines when not properly using the hips to generate torque in sport related motions and swings. While devices have been developed to practice swings associated with various sports such as golf, hockey, tennis, and baseball; a common feature of these devices is that once the practice swing has been completed, the user has to stop the forward motion of the swing. This deceleration leaves a user prone to injury and inhibits development of proper action muscle memory. An alternative set of devices involves contact with a practice ball or other object to create deceleration, but are inadequate for training purposes in that the swing motion is normal speed thereby preventing muscle memory to efficiently develop.

Thus, there is a need in the art for improved devices and methods for preparing the body for fitness and sporting based activities in order to mitigate and avoid injuries.

SUMMARY OF THE INVENTION

A method is provided for preventing back injuries related to sport motions or swings that includes setting an attachment height of a distal end of an elastic of a warmup and training device, the attachment height set to define an angle $\alpha$ backwards from vertical above center of a practice motion specific to a sport to be practiced. A handle is attached to a proximal end of the elastic where the type of handle corresponds to the sporting activity to be performed. A practice motion is performed while holding the handle and stretching the elastic, and then returned to the beginning of the practice motion to repeat the activity.

BRIEF DESCRIPTION OF THE DRAWINGS

Examples illustrative of embodiments of the present invention are described below with reference to figures attached hereto. In the figures, identical structures, elements or parts that appear in more than one figure are generally labeled with a same numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

The present invention has utility as a device and method for preventing injuries and improving sports performance. By using embodiments of the inventive device, a person learns hip engagement into a sports motion that dramatically reduces back injuries by putting more of the rotational force on the lower body and legs rather than on the spine of the person.

Depending on the expected motion involved in the sporting or exercise activity that a user is to participate in, the relative height of attachment of an elastic is set. With resort to the elastic, a user performs a slower than actual sport motion that upon reaching maximal extension, is drawn back to the start position by the user simply relaxing the engaged muscles. In addition, different handle attachments may be attached to the elastic band or spring based on the sport for which the person is planning on participating in. Examples of handles used in embodiments of the inventive device may include a handle for a golf club, a tennis racket handle, a baseball bat handle, the shaft of a hockey stick, a boxing glove, an arrow shaft, or a grip simulating an American football. It has been surprisingly found that resort to an elastic that is anchored allows a user to practice hip engagement and thereby improve their games skills and reduce spinal usage. As a result, lower back injuries are reduced in users training with the inventive device.

Figure 1A:
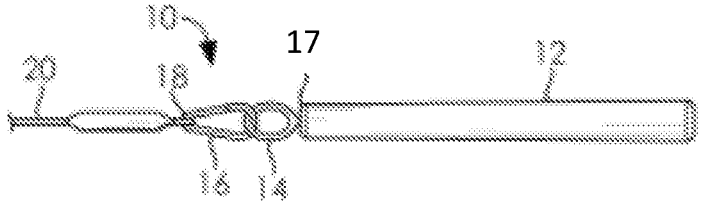
FIGS. 1A and 1B are photographs of a warmup device with a handle connected to an elastic band or cord in accordance with embodiments of the invention.
Figure 1B:
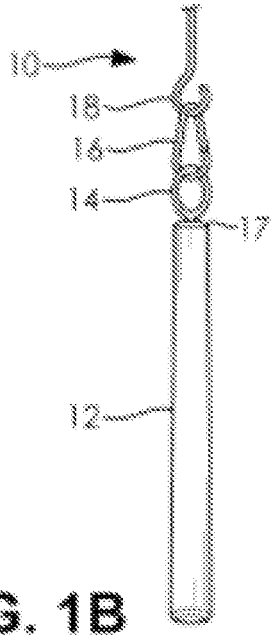

Referring now to the figures, FIGS. 1A and 1B an inventive warmup and training device 10 has a handle 12 in the form of a golf club handle that has a proximal end 17 terminated with an eye socket 14 that may be connected to a link 16. The link 16 attaches to an eyelet 18 of the elastic 20.

An elastic as used herein includes an elastomeric material in the form of a cord, band, braid, or a metal spring.

Figure 2:
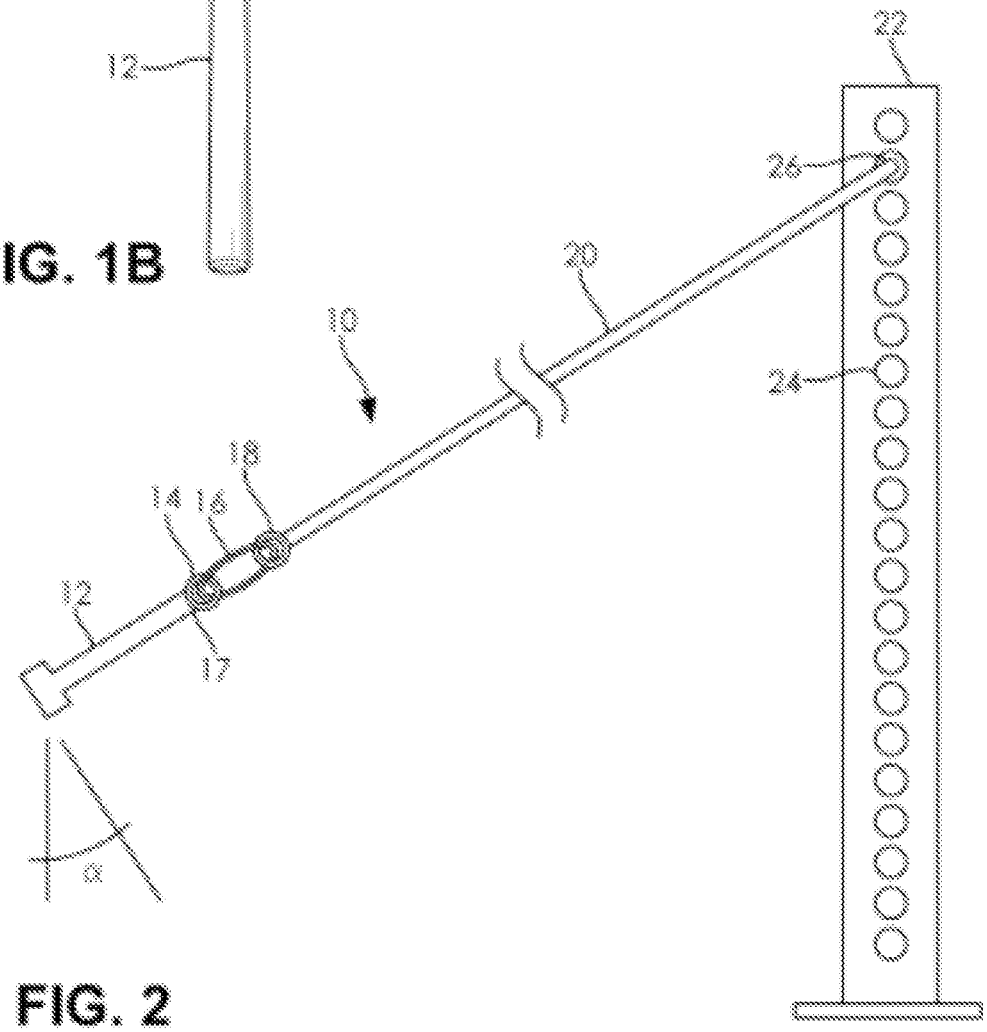
FIG. 2 is a side view of a standing post with a series of attachment points for a hook on the distal end of the band or cord of embodiments of the inventive warmup device.

The distal end of the elastic 20 may have a second eyelet or a loop like eyelet 18 adapted for attachment to a wall mounted hook. The height of the wall mounted hook may be varied relative to the user's waist (above, even, below) depending on the type of hip motion needed for the required sporting motion. In other use contexts, the distal end is modified to secure to variety of stationary features such as a backstop, a fence, a golf cart, a door frame, or the interface between and door and the frame. In a specific embodiment a standing post 22 with a series of attachment points 24 may be used for securing a hook 26 on the distal end of the elastic 20 of the device 10' as shown in FIG. 2. The handle 12' shown in FIG. 2 is a baseball bat handle in which like numerals have the meaning associated therewith per the aforementioned drawings. The post 22 is secured to a wall or to a floor to resist pulling of the elastic 20. An angle, a backwards (towards the elastic anchor) from vertical above center of practice motion are adjusted based on the sport to be practiced, where a 90 degree angle corresponds to an arm extension in line with the user shoulder. These are summarized in Table 1.

TABLE 1

Invention placement angle, in degrees.

| Sport | Angle, α in degrees |
|---|---|
| Golf -putt | 20 ± 5 |
| Golf-chip | 45 ± 5 |
| Golf-drive | 90 ± 8 |
| Tennis-volley | Variable with ball contact height |
| Archery draw* | 90 ± 3 |
| Hockey -wrist shot | 10 ± 3 |
| Hockey -snap shot | 20 ± 5 |
| Hockey -backhand shot | 20 ± 5 |
| Hockey -slap shot | 80 ± 15 |
| Baseball | 90 ± 9 |
| Boxing -jab | 90 ± 4 |
| Football - throw | 100 ± 10 |

*Performed facing the elastic anchor

Figure 3A:
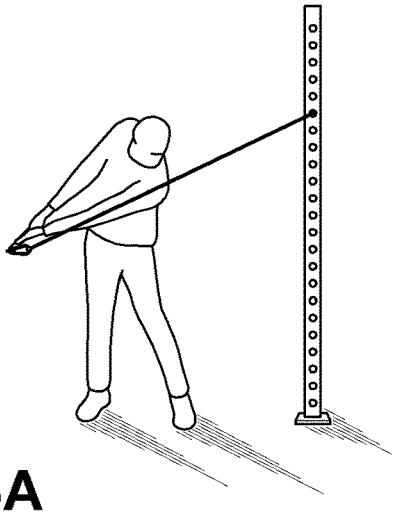
FIGS. 3A-3C are schematics of the elastic band or cord mounted above the waist of a user in accordance with embodiments of the invention in release position (FIG. 3A), address position (FIG. 3B) and takeaway position (FIG. 3C)
Figure 3B:
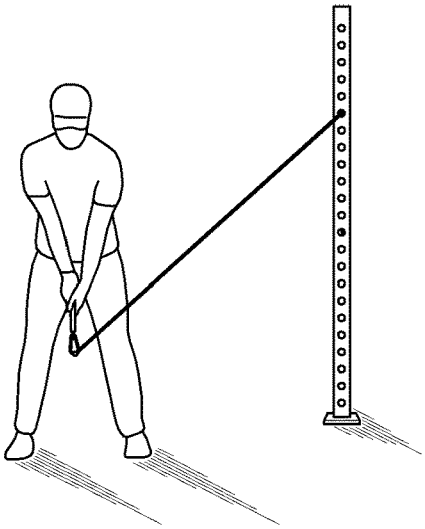
Figure 3C:
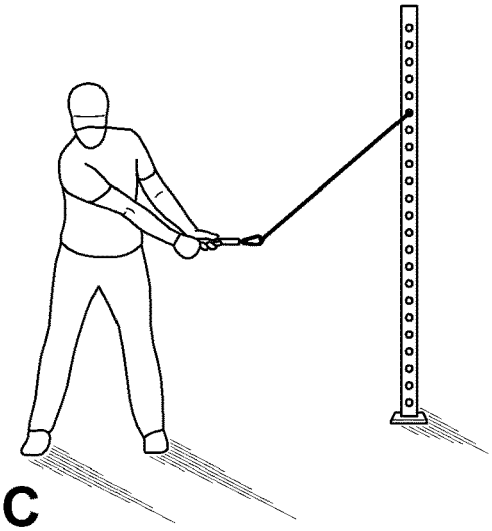
Figure 4A:
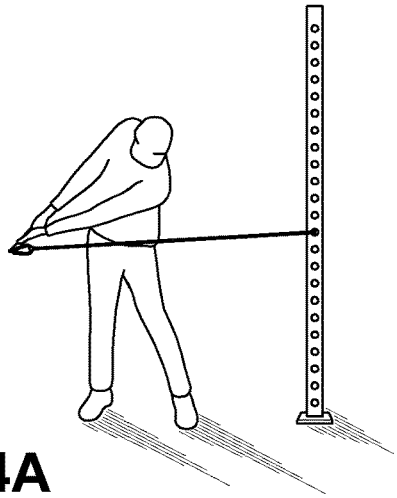
FIGS. 4A-4C are schematics of the elastic band or cord mounted even with the waist of a user in accordance with embodiments of the invention in release position (FIG. 4A), address position (FIG. 4B) and takeaway position (FIG. 4C)
Figure 4B:
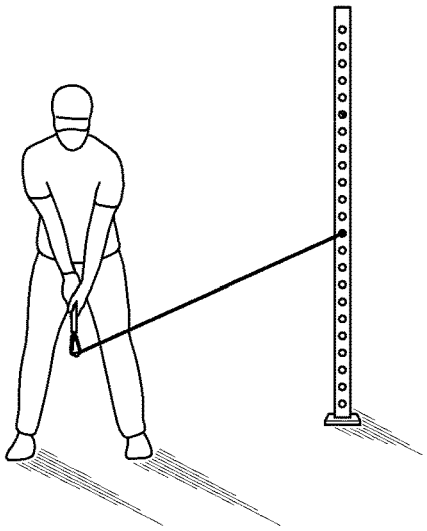
Figure 4C:
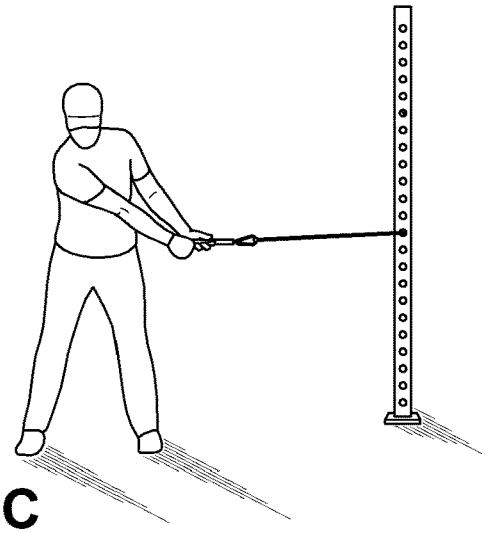
Figure 5A:
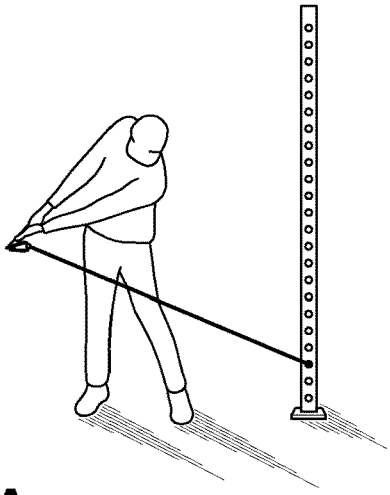
FIGS. 5A-5C are schematics of the elastic band or cord mounted below the waist of a user in accordance with embodiments of the invention in release position (FIG. 5A), address position (FIG. 5B) and takeaway position (FIG. 5C).
Figure 5B:
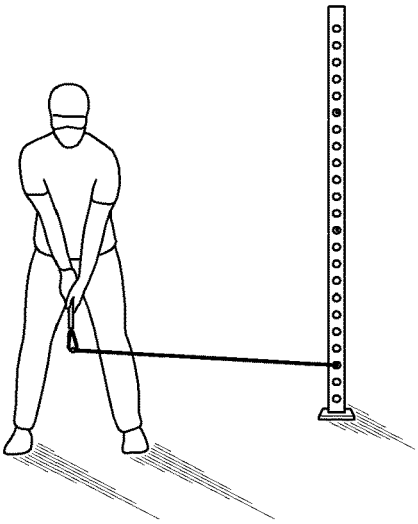
Figure 5C:
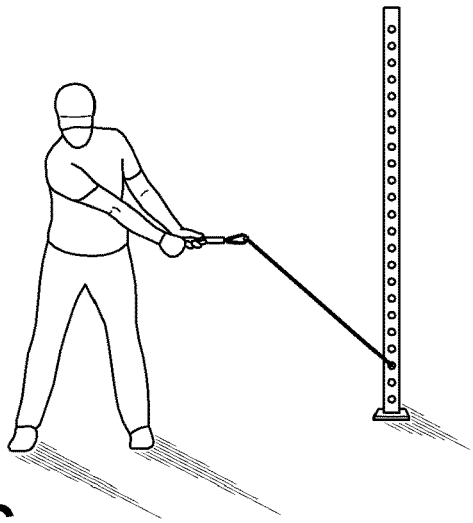

FIGS. 3A-3C are schematics of the elastic mounted above the waist (dotted line) of a user to simulate sports motions that may be used in for example swing of a golf club. FIG. 4A-4C are schematics of the elastic mounted to simulate sports motions used in for example swinging a baseball bat. FIGS. 5A-5C are schematics of the elastic mounted to simulate sports motions used in for example swinging a tennis racket in a groundstroke.

A method of using embodiments of the inventive warmup and training device for preventing injuries and incidentally improving sports performance includes setting the attachment height of the distal end of the band or cord relative to the waist of the user based on the motion of the sporting activity to be performed; attaching a handle to the proximal end of the elastic where the handle corresponds to the sporting activity to be performed; performing the sports motion or swing while holding the handle and stretching the band or cord; returning to the beginning of the sports motion or swing to repeat the activity.

In some inventive embodiments, a user is provided with instructional videos that provide the user with education content as to proper practice motion with a given type of handle (sport), hip engagement timing relative to arm extension, head position during the practice motion, or a combination of any of the aforementioned. In still other embodiments, a subject uses the present invention with a sensor array to quantify hip engagement relative to torso and shoulder rotation. J. B. Myers et al. "The role of upper torso and pelvis rotation in driving performance during the golf swing"; Journal of Sports Sciences 26(2):181-8; February, 2008; the contents of which are hereby incorporated by reference.

The present invention is further detailed with respect to the following non-limiting examples.

The low back is the most common injury sustained whilst playing golf, and the dynamic action of the golf swing is a major contributing factor to injury. The golf swing is a complex movement that utilizes the whole body in a coordinated fashion and when repeated frequently can result in injury. Injury can be overuse or traumatic in nature. Amateur golfer injury tends to occur secondary to an incorrect golf swing and occurs in 15-34% of amateur golfers surveyed. Injuries are found between vertebrae L4 and L5. A cadre of 8 league amateur golfers who had experienced lower back injury are trained using the inventive device as shown in FIGS. 3A-3C at a start position of 90 degrees corresponding to the beginning movement of a drive, 45 degrees, and 20 degrees for 20 minutes, once a week for 10 weeks prior to league commencement. These golfers reported no subsequent lower back injuries. In contrast, a like group of amateur golfers in the same league playing with the same frequency as the trained golfers and who did not train with the inventive device reported 2 recurring lower back injuries during the golf season.

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of elements without departing from the scope as set forth in the appended claims and the legal equivalents thereof.

The invention claimed is:

1. A method for preventing back injuries related to sport motions or swings, comprising:
   - setting an attachment height of a distal end of an elastic of a warmup and training device, the attachment height set to define an angle α backwards from vertical above center of a practice motion specific to a sport to be practiced;
   - attaching a handle to a proximal end of the elastic where a type of the handle corresponds to the sports motions or swings to be performed;
   - performing the practice motion slower than the sports motions or swings while holding the handle and stretching the elastic; and
   - upon reaching maximal extension of the practice motion, returning to a beginning of the practice motion by a user simply relaxing engaged muscles to repeat the activity, thereby avoiding user-driven deceleration to prevent back injuries related to the sports motions or swings.

2. The method of claim 1 wherein the setting of the attachment height of the distal end of the elastic further comprises attaching a hook at the distal end of the elastic to a standing post, the standing post with a series of attachment points for securing the hook.

3. The method of claim 2 wherein the standing post is secured to a wall or to a floor to resist pulling of the elastic.

4. The method of claim 1 wherein the angle is 20±5, 45±5, or 90±8 and said handle is golf grip.

5. The method of claim 1 wherein the angle is 10±5, 20±5, or 80±15 and said handle is a hockey stick grip.

6. The method of claim 1 wherein the angle is 90±9 and said handle is baseball bat grip.

7. The method of claim 1 wherein said handle is a tennis racket handle.

8. The method of claim 1 wherein the elastic is a band or cord formed of elastomeric material.

9. The method of claim 1 wherein the setting of the attachment height of the distal end of the elastic further comprises attaching the distal end to a hook secured to a wall.

10. The method of claim 1 further comprising showing a user a video of proper form for the practice motion.

* * * * *